US006505424B2

(12) United States Patent
Oorei et al.

(10) Patent No.: US 6,505,424 B2
(45) Date of Patent: Jan. 14, 2003

(54) ATHLETIC SHOE STRUCTURE

(75) Inventors: Takeshi Oorei, Osaka (JP); Yoshihide Shibahara, Osaka (JP); Mitsuhiro Kawano, Osaka (JP); Tetsuo Yamamoto, Osaka (JP); Kazuhiko Suzuki, Osaka (JP)

(73) Assignee: Mizumo Corporation, Osaka (JP)

( * ) Notice: Subject to any disclaimer, the term of this patent is extended or adjusted under 35 U.S.C. 154(b) by 0 days.

(21) Appl. No.: 09/842,891

(22) Filed: Apr. 26, 2001

(65) Prior Publication Data

US 2002/0148142 A1 Oct. 17, 2002

(30) Foreign Application Priority Data

Apr. 11, 2001 (JP) ..... 2001-112653

(51) Int. Cl.[7] ..... A43B 5/06; A43B 7/20; A43C 11/00

(52) U.S. Cl. ..... 36/129; 36/50.1; 36/89; 36/72 R

(58) Field of Search ..... 36/129, 50.1, 58.5, 36/89, 72 R

(56) References Cited

U.S. PATENT DOCUMENTS

| | | | | | |
|---|---|---|---|---|---|
| D47,238 | S | * | 4/1915 | Miller | 36/45 |
| 3,310,889 | A | | 3/1967 | Samuels | 36/72 |
| 3,906,642 | A | * | 9/1975 | Cohen | 36/112 |
| 3,921,313 | A | * | 11/1975 | Mahide et al. | 36/4 |
| 4,107,857 | A | | 8/1978 | Devlin | 36/129 |
| 4,132,016 | A | * | 1/1979 | Vaccari | 36/10 |
| 4,649,939 | A | * | 3/1987 | Curtis | 36/89 |
| 5,243,772 | A | * | 9/1993 | Francis et al. | 36/106 |
| 5,271,130 | A | * | 12/1993 | Batra | 24/714.6 |
| 5,408,761 | A | * | 4/1995 | Gazzano | 36/102 |
| 5,463,822 | A | * | 11/1995 | Miller | 36/50.1 |
| 5,992,057 | A | | 11/1999 | Monti | 36/89 |
| 6,128,835 | A | * | 10/2000 | Ritter et al. | 36/114 |
| 6,286,233 | B1 | * | 9/2001 | Gaither | 36/50.1 |

FOREIGN PATENT DOCUMENTS

| | | |
|---|---|---|
| JP | 8-131201 | 5/1996 |
| JP | 8-317806 | 12/1996 |

* cited by examiner

*Primary Examiner*—Ted Kavanaugh
(74) *Attorney, Agent, or Firm*—Troutman Sanders LLP; Gerald R. Boss; Ryan A. Schneider

(57) ABSTRACT

An athletic shoe includes a sole, an upper, a plurality of band-shaped members, and a fastening member. The upper has a toe portion, a heel portion, a forefoot portion and a lower periphery. The upper is secured to the sole and has a plurality of elongated through holes at regions except the toe portion and the heel portion. The band-shaped members are secured to the sole or the lower periphery of the upper and extend upwardly toward an instep of a foot of a shoe wearer. The fastening member is connected to each upper end of the band-shaped members.

10 Claims, 7 Drawing Sheets

ATHLETIC SHOE STRUCTURE

This application claims priority from Japanese patent application No. 2001-112653 filed Apr. 11, 2001.

BACKGROUND OF THE INVENTION

The present invention relates to an athletic shoe, and especially, to a competition track shoe and a running shoe. More specifically, this invention concerns an improved structure of an athletic shoe for an advanced fittability, weight lightening, and reduction in air resistance.

In athletic shoes, since there has been a strong request for weight lightening to improve time in track meets, reconsideration for materials of shoe components and research and development of new materials have been made. However, there remain certain limitations in weight lightening by employing lighter materials.

On the other hand, improved structures for weight lightening of athletic shoes have been developed. For example, U.S. Pat. No. 4,107,857, to Devlin, discloses an athletic shoe having three pairs of straps on a medial and lateral side instead of employing an upper that covers the whole foot of a shoe wearer. Each pair of the straps is fastened to each other through a tongue member.

However, in this case, a wearer must fasten a corresponding pair of straps to each other, which is very troublesome. Moreover, the prior art shoe has a larger number of components, which makes the structure of a shoe complicated.

Accordingly, it is an object of the present invention to provide an athletic shoe that not only improves fittability and decreases weight but also causes easy handling and simplifies a structure. Another object of the present invention is to reduce air resistance of an athletic shoe.

SUMMARY OF THE INVENTION

In one embodiment, an athletic shoe includes a sole, an upper, a plurality of spaced, band-shaped members, and a fastening member. The upper has a toe portion, a heel portion, a forefoot portion and a lower periphery. Also, the upper is secured to the sole and has a plurality of elongated through holes at regions except the toe portion and the heel portion. The band-shaped members are secured to the sole or the lower periphery of the upper and extend upwardly toward an instep of a foot of a shoe wearer. The fastening member is connected to each upper-end of the band-shaped members.

In this embodiment, since a plurality of elongated through holes are formed in the upper, weight of a shoe is lightened. Also, because the band-shaped members extend upwardly toward an instep of a shoe wearer and are connected to the fastening member at the upper ends thereof, fastening and tightening by a fastening member such as a shoelace can be collectively conducted at an instep portion. Thus, tensile direction of each band-shaped member is regulated and optimum fittability is realized at the time of fastening of the fastening member and besides, easy handling of a fastening member is achieved. Moreover, since the upper having a plurality of elongated through holes covers a foot of a shoe wearer, the number of shoe components is decreased, thereby simplifying the whole shoe structure.

In a second embodiment, an athletic shoe includes a sole, a toe guard portion, a heel guard portion, an opening reinforcement member of band-shape, a plurality of spaced, band-shaped members, and a fastening member. The toe guard portion protects a toe of a shoe wearer and is secured to the sole. The heel guard portion protects a heel of a wearer and is secured to the sole. The opening reinforcement member extends along the periphery of an opening for a foot entry into a shoe. The band-shaped lo members are secured to the toe guard portion, the heel guard portion, and the sole, and extend upwardly toward an instep of a wearer, and are connected to the opening reinforcement member. The fastening member is connected to each upper end of the band-shaped members.

In this embodiment, since a foot of a wearer is covered with a toe guard portion, a heel guard portion, an opening reinforcement member, and a plurality of spaced, band-shaped members, weight of a shoe is decreased. Also, because the bandshaped members extend upwardly toward an instep of a wearer and are connected to the fastening member at the upper ends thereof, fastening and tightening by a fastening member such as a shoelace can be collectively conducted at an instep portion. Thus, tensile direction of each band-shaped member is regulated and optimum fittability is realized at the time of fastening of the fastening member and besides, easy handling of a fattening member is achieved. Moreover, this athletic shoe is comprised of a relatively smaller number of shoe components, which simplifies the whole shoe structure.

Each of the band-shaped members may be formed of synthetic resin fiber of higher elasticity. Lower ends of the band-shaped members are located at a first region extending from a position corresponding to a thenar eminence to a position corresponding to a calcaneus of a wearer on a medial side of the sole, a second region extending from a position corresponding to a hypothenar eminence to a position corresponding to a calcaneus of a wearer on a lateral side of the sole, a first position corresponding to a head of a proximal phalanx of a first toe of a wearer, and a second position corresponding to a bottom of a distal phalanx of a fourth toe of a wearer. Thereby, a region except a toe portion is properly tightened.

A band-shaped tightening member may further be provided that extends from the heel portion to the medial and lateral portions of a shoe. A portion of this tightening member is engaged with the heel portion, and the medial and lateral extending portions are folded back toward an instep of a shoe at turning portions provided at lower regions on the medial and lateral sides of the shoe. Each distal end of the medially and laterally extending portions of the tightening member is tightened to an instep of a shoe wearer.

In this case, since a tightening member wraps around an ankle of a wearer and extends forward to the lower peripheries of the medial and lateral sides and is folded back to extend upward to an instep of a wearer, a heel portion of the upper can be tightly contacted with a heel portion of a wearer when the tightening member is tightened at an instep portion, thereby advancing fittability of a shoe.

In a preferred embodiment of the present invention, an openable cover sheet is provided that covers at least a forefoot portion of an upper of a shoe or covers a region corresponding to at least a forefoot portion of a wearer. In this case, the cover sheet covers the through holes at the forefoot portion or covers gaps formed between the adjacent bend-shaped members, which reduces irregularities of the outer surface of a shoe and smoothes the outer surface. Thus, air resistance of a shoe is lowered and time can be advanced in athletic meets.

Also, due to the cover sheet that covers the through holes at the forefoot portion of a shoe or covers the gaps formed between the adjacent band-shaped members at the forefoot portion of a shoe, dirt or rain is prevented from entering the shoe through the forefoot portion, and the forefoot portion of a wearer is prevented from being wounded. Moreover, since the cover sheet covers the whole forefoot portion of a shoe, integrated aesthetic appearance of the forefoot portion of a shoe can be described by the cover sheet.

A lower periphery of the cover sheet is secured to or detachably attached to a sole or lower edge portions of the upper. Alternatively, a lower periphery of the cover sheet is secured to or detachably attached to a toe guard portion and a sole. Here, a term, "secured" means to be fixed by sewing, bonding, heat welding, or the like. Also, a term "detachably attached" means to be fitted removably by a fastener, buckle, button, hock, hook, or the like.

A side reinforcement member of band-shape may be provided along the lower edges of the medial and lateral sides to connect the toe guard portion with the heel guard portion, and the lower periphery of the cover sheet may be secured to or detachably attached to the toe guard portion and the side reinforcement member.

The cover sheet may be formed of expandable stretch material. Here, a term, "stretch material" means a resilient material that can expand moderately like skins corresponding to body movements.

Embossing finish or calendering finish may be performed on a surface of the cover sheet. Here, "embossing finish" means a surface finish that causes irregularities on the surface of the material by applying pressure on the surface of the material at an elevated temperature. "Calendering finish" means a surface finish that makes the surface of the material flat by applying pressure on the surface of the material at an elevated temperature. The purpose of both finishes is to reduce air resistance due to turbulence effect or laminar flow effect.

BRIEF DESCRIPTION OF THE DRAWINGS

For a more complete understanding of the invention, reference should be made to the embodiments illustrated in greater detail in the accompanying drawings which are not to scale, and described below by way of examples of the invention.

DETAILED DESCRIPTION OF THE PREFERRED EMBODIMENTS

Figure 1:
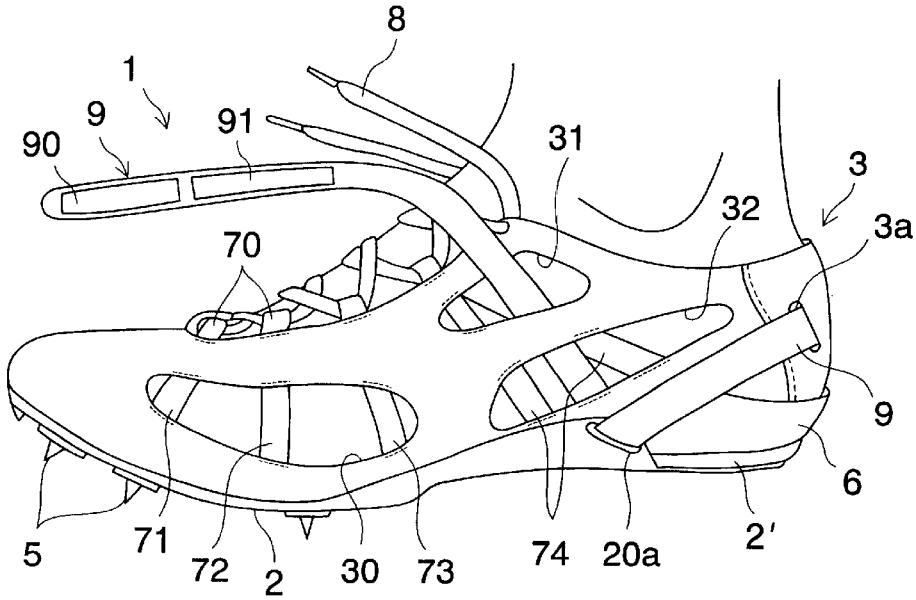
FIG. 1 is a lateral side view of an athletic shoe according to one embodiment of the present invention.
Figure 2:
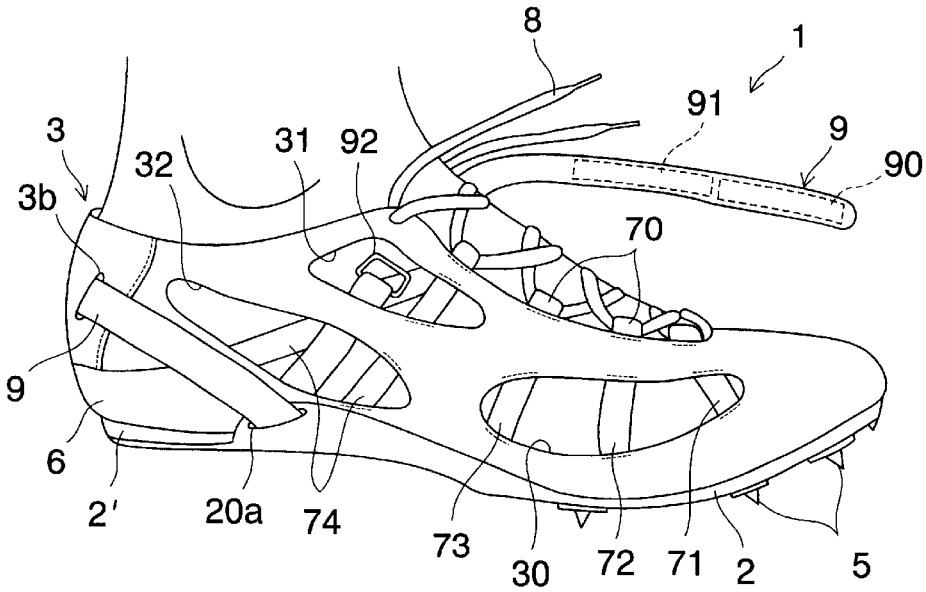
FIG. 2 is a medial side view of FIG. 1.

Turning now to the drawings, FIGS. 1 to 5 show an athletic shoe of one embodiment of the present invention. As shown in FIGS. 1 and 2, an athletic shoe 1, which is designed for a sprint or a short-distance dash, includes an outsole 2 extending along the whole shoe from a toe portion to a heel portion, an upper 3 secured to the outsole 2, and a plurality of spaced, band-shaped members 71 to 74.

The outsole 2 is formed of a relatively hard synthetic resin with higher modulus of elasticity and has a plurality of studs 5 at a lower bottom surface thereof. These studs 5 are made of ceramics, metal, hard plastics, or the like and are fixed with a screw on the lower bottom surface of the sole 2. In the alternative, the studs 5 may be formed or molded integrally with the outsole 2. The outsole 2 has an upraised portion 20 extending upwardly on each of the medial and lateral sides in front of the heel portion of the outsole 2, and the upraised portion 20 is formed with a slit 20*a*.

A midsole 2' extending from the heel portion to the midfoot portion is fixed to the upper surface of the outsole 2. The midsole 2' may be generally formed of thermoplastic synthetic resin foam such as ethylene-vinyl acetate copolymer (EVA). A plastic heel counter 6 is provided over the outsole 2 to maintain a shape of the heel portion of a shoe.

The upper 3 has a plurality of through holes 30, 31 and 32 formed therein. These through holes 30, 31, 32 are formed at regions except a toe portion and a heel portion of a shoe on a medial and lateral side. Each of the through holes 30, 31, 32 is elongated in a generally longitudinal direction of a shoe. A pair of slits 3*a* and 3*b* are formed on a medial and lateral side at a heel portion of the upper 3.

Inside the upper 2, there are provided a plurality of spaced, band-shaped members 71, 72, 73 and 74 that extend upwardly toward an instep of a wearer from a lower portion of a shoe. These band-shaped members 71 to 74 are provided at a medial side and a lateral side of a shoe, respectively, and wrap around the instep of a shoe.

Each of the band-shaped members 71 to 74 is formed of a material having a higher tensile strength and a higher modulus of elasticity to effectively transmit the reaction of a kick to the sole of a foot from the ground. Specifically, polyethylene fibers, polyacetal fibers, or polyvinyl alcohol fibers having a tensile strength of 15 g/d or more and a modulus of elasticity of 500 g/d or more may be preferably used. Nylon fibers or polyester fibers may also be used.

The band-shaped members 71 to 74 may be sewn onto the edge portions of the openings of the through holes 30 to 32 of the upper. Alternatively, the band-shaped members 71 to 74 may be provided slidably in a pocket formed in the upper 3 without being sewn onto the upper 3. Lower ends of the band-shaped members 71 to 74 are fixed to the lower periphery of the upper 3. Gaps formed between the adjacent band-shaped members 71 to 74 are gradually narrowed as the members 71 to 74 go upwardly toward the instep, and each upper end of the band-shaped members 71 to 74 is formed with a turning portion 70 of loop-shape. A shoelace 8 is inserted into each turning portion 70 of the band-shaped members 71 to 74. Tightening a shoelace 8 causes the upper 3 to be pulled toward a foot of a wearer through the band-shaped members 71 to 74, which makes the outsole 2 and the midsole 2' secured to a sole of a wearer. A belt 74 is folded back at the instep portion and the distal end of the belt 74 is. fixed to the rear end portion of the heel portion.

In addition, a metallic or plastic. D-shaped loop ring may take the place of the turning portion 70 to fasten each corresponding belt on a medial and lateral side.

By considering a bone structure and movable portions of a foot, lower fitted positions of the belts 71 to 74 are determined so as to effectively fasten and tighten a foot.

Figure 3:
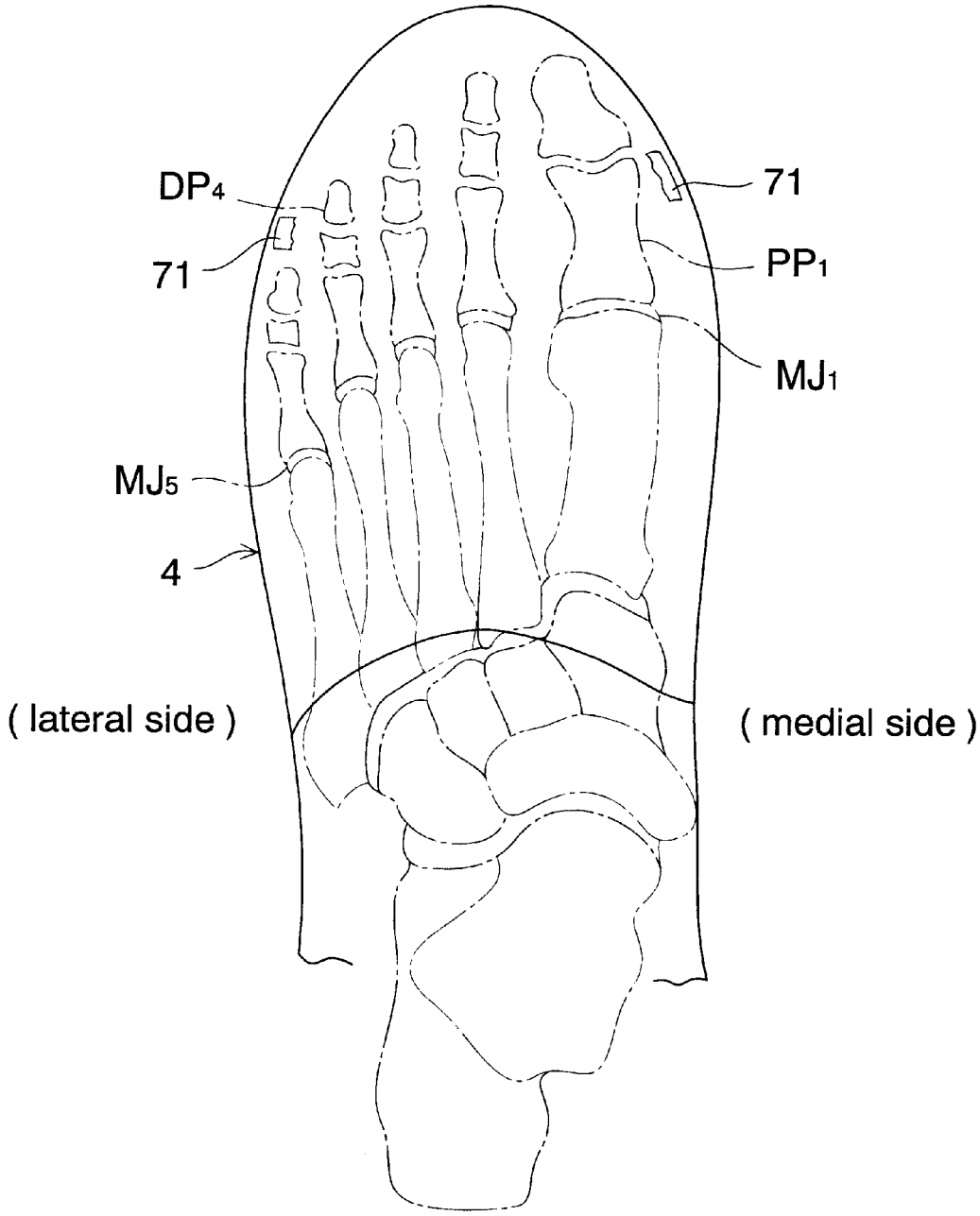
FIG. 3 is a schematic illustrating an anatomical relationship between the bone structure of a foot and the lower fitted position of a band-shaped member.

As shown in FIG. 3, the lower fitted position of the belt 71 on a lateral side is placed at a position corresponding to the bottom portion of the fourth distal phalanx $DP_4$ of a foot and the lower fitted position of the belt 71 on a medial side is placed at a position corresponding to the head portion of the first proximal phalanx $PP_1$ of a foot.

The lower fitted positions of the belts 72 to 74 are disposed at a first region extending from the hypothenar to the calcaneus of a foot on a lateral side, and at a second region extending from the thenar to the calcaneus of a foot on a medial side.

The width of each of the belts 71 to 74 may be constant or may be varied according to the fitted position. For example, a belt disposed at the arch of a foot may be wider, whereas belts disposed around a forefoot portion, toe portion and heel portion may be narrower. Additionally, the number of belts is not limited to this embodiment, but may be varied according to the size of a shoe or the width of each belt.

Each tilting angle of the belts 72, 73 and 74 is determined at about 0 to 90 degrees, preferably, about 20 to 70 degrees, as measured from the front side of the fitted position. Similarly, a tilting angle of the belt 71 is determined at about 60 to 180 degrees, preferably, about 90 to 150 degrees, as measured from the front side of the fitted position.

A tightening member 9 is provided on a medial side and a lateral side of a heel portion of a shoe. The tightening member 9 is inserted into slits 3*a* and 3*b*, which are formed on the medial side and the lateral side at the heel portion of the upper 3. Each of the medial and lateral extending portions of the belt 9 is inserted into a slit 20*a* formed at the upraised portion 20 of the sole 2 and is folded back toward the instep.

The lateral extending portion of the tightening belt 9 is longer than the medial extending portion and has a pair of hook-and-loop fasteners 90, 91 attached at its distal end. On the other hand, the medial extending portion of the tightening belt 9 has a buckle 92 at its distal end. When fastening the tightening belt 9, first, the lateral extending portion is inserted into the buckle 92 and folded back. Then, by attaching the fastener 90, 91 to each other, the lateral extending portion is fastened to the medial extending portion. In such a way, the tightening member 9 is tightened on the instep of a shoe.

Figure 4:
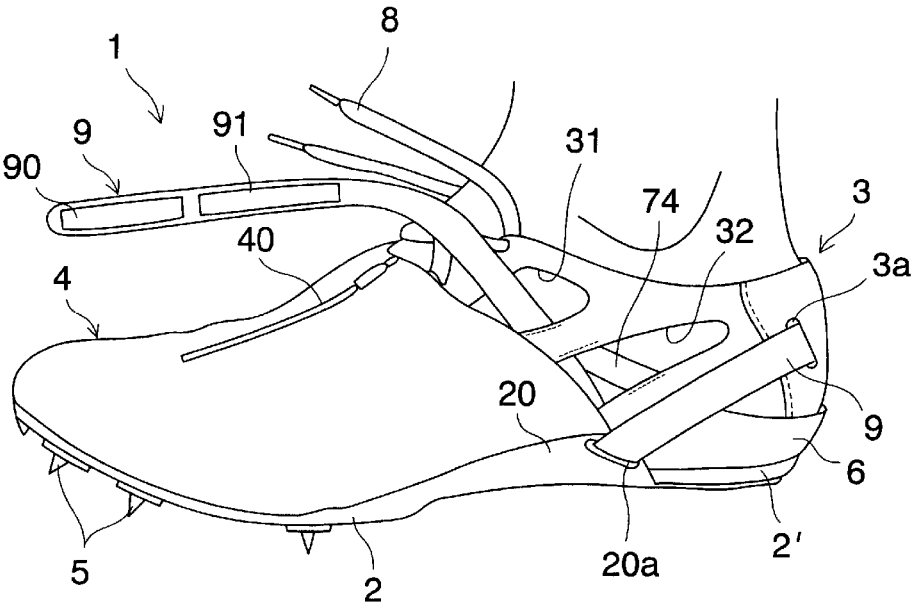
FIG. 4 is a lateral side view of an athletic shoe having a cover sheet attached on the forefoot portion of a shoe and showing the cover sheet closed.
Figure 5:
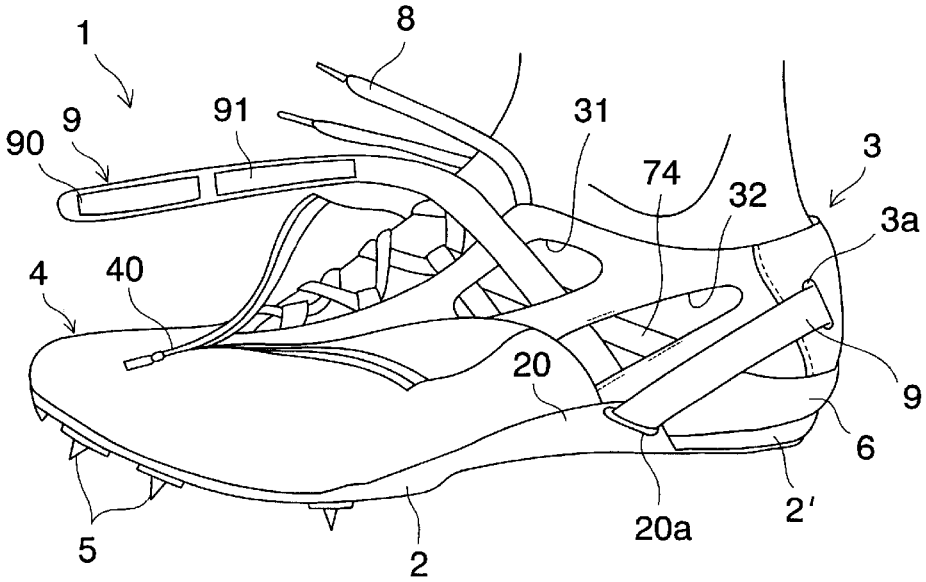
FIG. 5 is a lateral side view of an athletic shoe having a cover sheet attached on the forefoot portion of a shoe and showing the cover sheet open.
Figure 6:
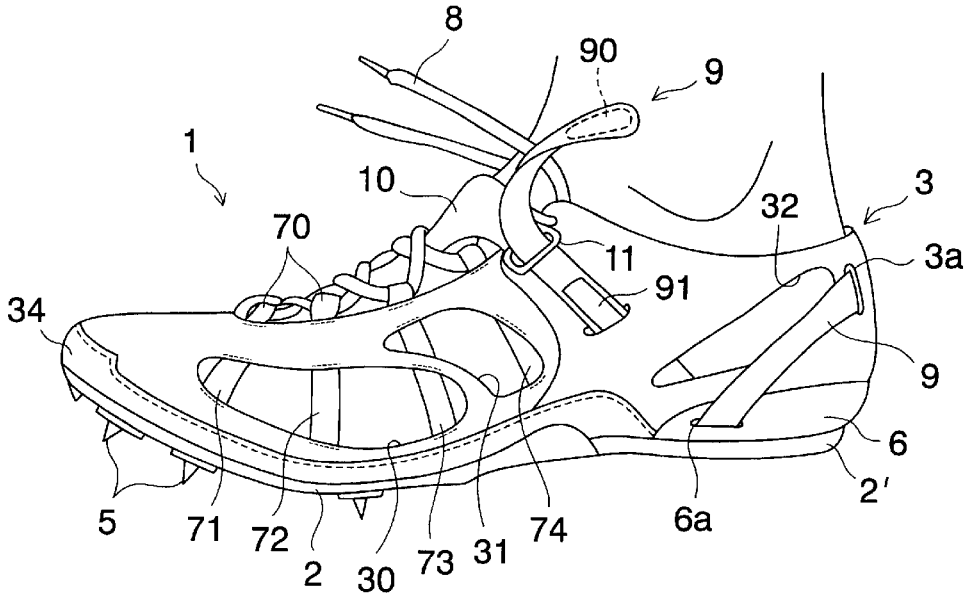
FIG. 6 is a lateral side view of an athletic shoe according to an alternative embodiment of FIG. 1.
Figure 7:
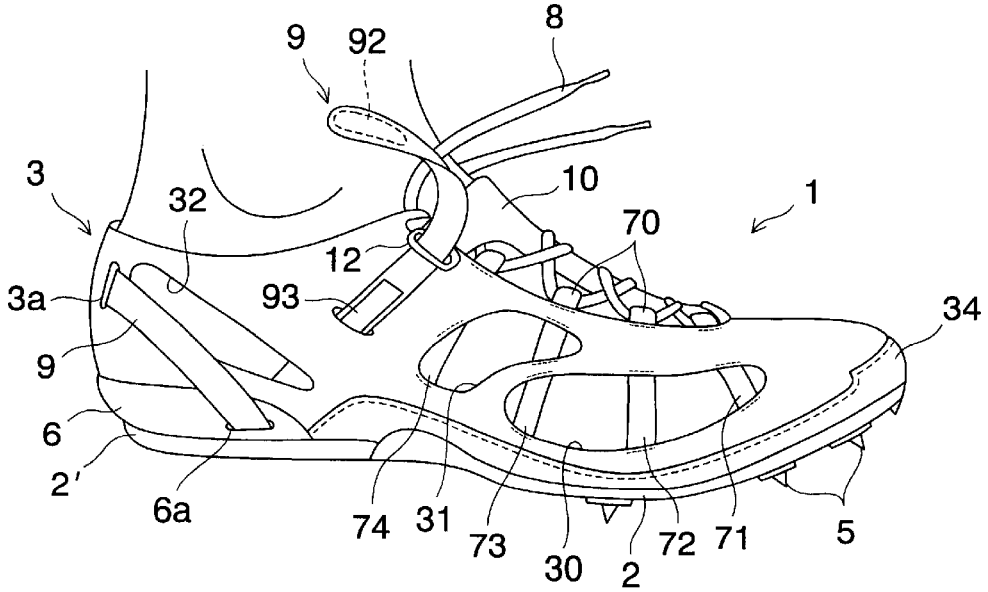
FIG. 7 is a medial side view of FIG. 6.
Figure 8:
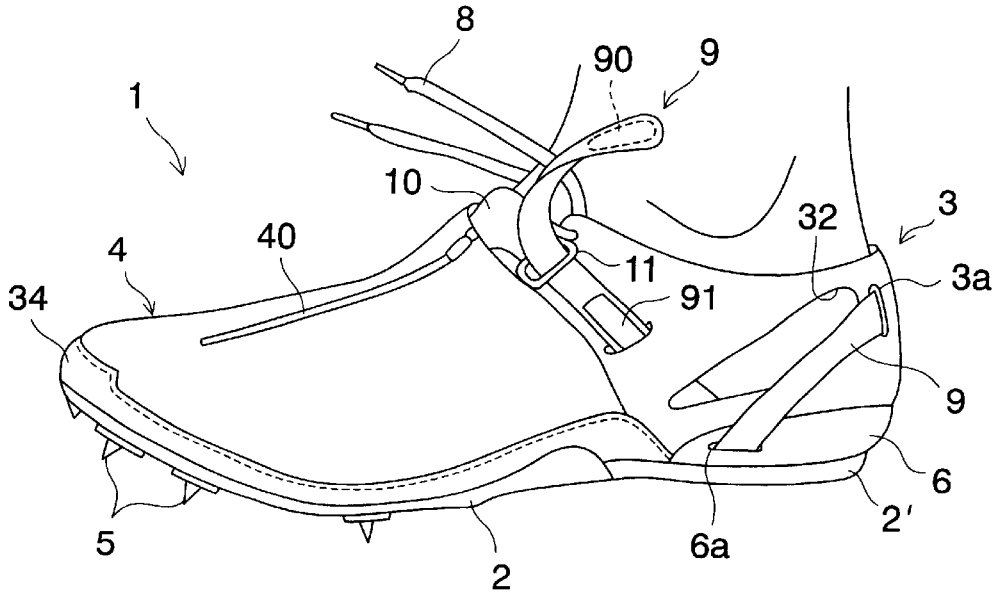
FIG. 8 is a lateral side view of an athletic shoe having a cover sheet attached on the forefoot portion of a shoe and showing the cover sheet closed.
Figure 9:
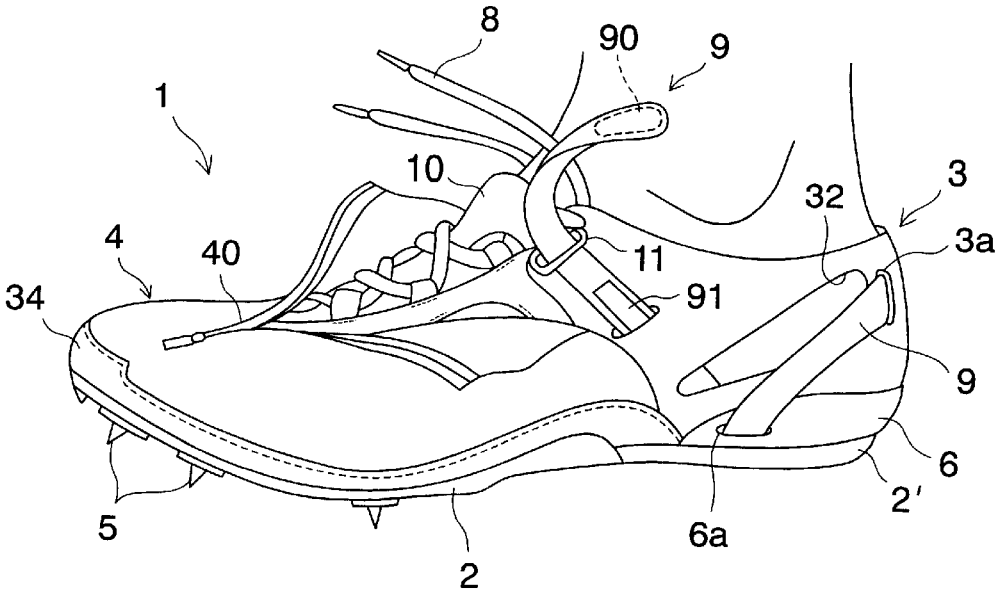
FIG. 9 is a lateral side view of an athletic shoe having a cover sheet attached on the forefoot portion of a shoe and showing the cover sheet open.

As shown in FIGS. 4 and 5, a cover sheet 4 may be provided to cover at east a forefoot portion of the upper 3. The cover sheet 4 is openable and closable by a zipper 40. A lower periphery of the cover sheet 4 may be secured to the outsole 2 or the lower periphery of the upper 3. Alternatively, a lower periphery of the cover sheet 4 may be detachably attached to the outsole 2, the lower periphery of the upper 3, or the midsole 2' through a fastener, button, hock, or hook.

The cover sheet 4 is formed of expandable stretch materials, preferably, half tricot stitch of stretch materials. Here, a term, "stretch material" means a resilient material that can expand moderately like skins corresponding to body movements. Also, a term, "half tricot stitch" is a kind of warp knitting to knit longitudinal loops in a row, which has been applied to an athletic wear, tights, swimming wear, and the like.

Also, the cover sheet 4 may be formed of a meshed material, "triaxial woven fabric", or a synthetic resin such as nylon, urethane or the like. Here, "triaxial woven fabric" means a woven fabric in which each component fiber is disposed 60 degrees apart from each other. The "triaxial woven fabric" has a higher strength, a superior shape retainability and an advanced durability. The cover sheet 4 may be formed of synthetic leather.

Embossing finish or calendering finish may be conducted on a surface of the cover sheet 4. Here, "embossing finish" means a surface finish that causes irregularities on the surface of the material by applying pressure on the surface of the material at an elevated temperature. "Calendering finish" means a surface finish that makes the surface of the material flat by applying pressure on the surface of the material at an elevated temperature. The purpose of both finishes is to reduce air resistance due to turbulence effect or laminar flow effect.

According to the first embodiment of the present invention, a plurality of elongated holes 30 to 32 in the upper 3 makes the weight of a shoe lighter. Also, the cover sheet 4 that covers a through hole 30 and portions of the through holes 31, 32 decreases the irregularities of the outer surface of a forefoot portion of a shoe and makes the outer surface smoother, which reduces air resistance of a shoe and contributes to an improvement in time at track meets.

Moreover, the cover sheet 4 that covers through holes at the forefoot portion prevents dirt or rain from entering the shoe and also prevents the forefoot portion of a foot of a wearer from being wounded. Furthermore, since the cover sheet 4 covers the whole forefoot portion of a shoe, integrated aesthetic appearance of the forefoot portion of a shoe can be described by the cover sheet 4.

FIGS. 6 to 9 illustrate an alternative embodiment of an athletic shoe for a sprint or a short-distance dash according to the present invention. FIGS. 6, 7, 8 and 9 correspond to FIGS. 1, 2, 4 and 5, respectively. This embodiment differs from the first embodiment in that a medial extending portion of the tightening belt 9 has generally the same length as a lateral extending portion, and a pair of fasteners 90, 91, and 92, 93 are respectively attached at each of the medial and lateral extending portions. Also, a tongue piece 10 is provided at the instep portion, and buckles 11 and 12 are provided to the opposite ends of the tongue piece 10. Furthermore, as a turning portion of a medial and lateral extending portion of a tightening belt 9, a slit 6*a* formed at a heel counter 6 is used.

In this embodiment, when tightening a tightening belt 9, first, a lateral extending portion is inserted into a buckle 11 on the lateral side and folded back rearwardly. Then, by attaching the fasteners 90, 91 to each other, the lateral extending portion is fastened to the buckle 11. Similarly, a medial extending portion is inserted into a buckle 12 on the medial side and folded back rearwardly. Then, by attaching the fasteners 92, 93 to each other, the medial extending portion is fastened to the buckle 12.

In addition, each position and shape of the through holes 30, 31 and 32 formed in the upper 3 are rather different from that of the first embodiment, but in this embodiment as well, there are three through holes formed on a medial and lateral side of the upper 3. respectively.

According to this embodiment, as with the first embodiment, a plurality of elongated through holes 30 to 32 are formed on the medial and lateral side of the upper 3, which makes the weight of the shoe lighter. A cover sheet 4 that covers the through holes 30, 31 of the forefoot portion of the upper 3 decreases the irregularities of the outer surface of a shoe and smoothes the outer surface to reduce the air resistance.

Moreover, a cover sheet 4 prevents dirt or rain from entering a shoe through the forefoot portion of a shoe and also prevents the forefoot portion of a wearer from being wounded. Furthermore, since the cover sheet 4 covers the whole forefoot portion of a shoe, integrated aesthetic appearance of the forefoot portion of a shoe can be described by the cover sheet 4.

Figure 10:
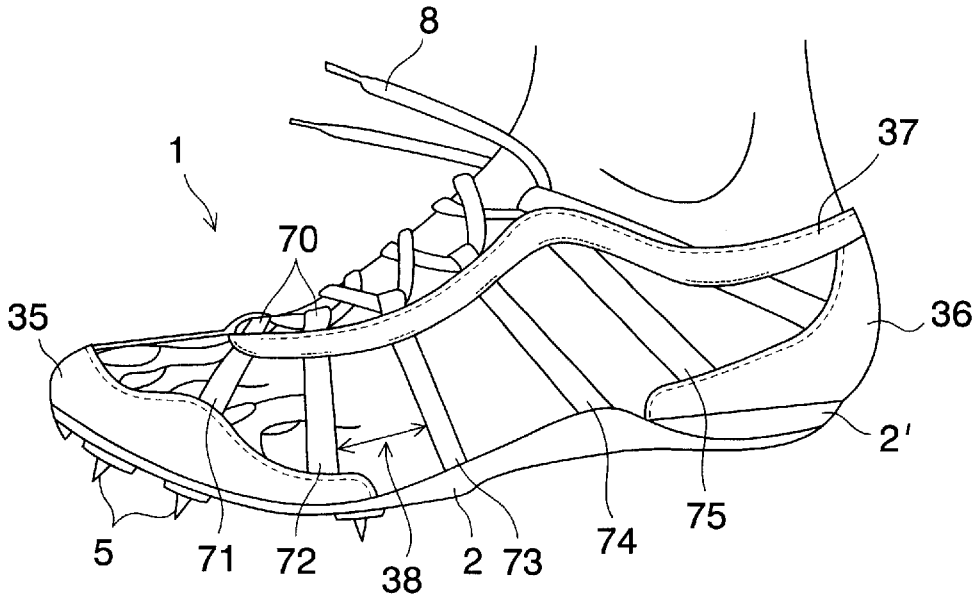
FIG. 10 is a lateral side view of an athletic shoe according to a second embodiment of the present invention.
Figure 11:
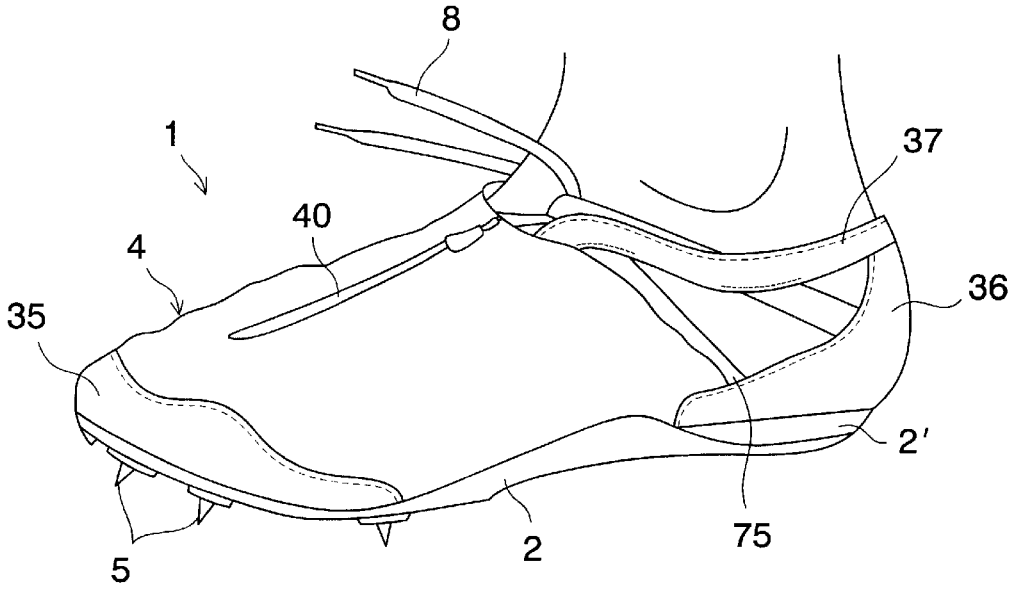
FIG. 11 is a lateral side view of an athletic shoe having a cover sheet attached on the forefoot portion of a shoe and showing the cover sheet closed.
Figure 12:
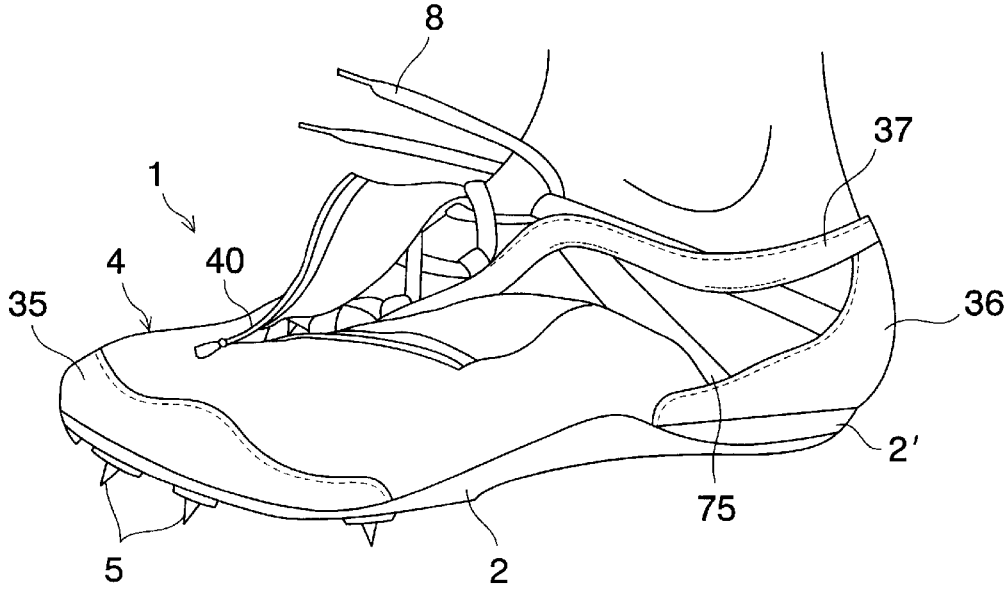
FIG. 12 is a lateral side view of an athletic shoe having a cover sheet attached on the forefoot portion of a shoe and showing the cover sheet open.

FIGS. 10 to 12 show a second embodiment of an athletic shoe for a sprint or a short-distance dash according to the present invention. This second embodiment differs from the first embodiment in that there is not provided any upper. As shown in FIG. 10, an athletic shoe 1 includes a toe guard portion 35 secured to an outsole 2 and protecting a toe portion of a wearer, and a heel guard portion 36 secured to a midsole 2' and protecting a heel portion of a wearer. Also, an opening reinforcement member 37 of band-shape is provided along the periphery of an opening of a shoe for receiving a foot of a wearer. The opening reinforcement member 37 wraps around an ankle of a foot and extends toward an instep.

Also, in this second embodiment, a belt 75 is substituted for a tightening belt of the first and second embodiments. A lower end of the belt 75 is fixed to the heel guard portion 36. An upper end of the belt 75 is folded back at an instep portion and extends downwardly, and the distal end thereof is secured to the heel portion 36.

Each fitting position and tilting angle of the other belts 71 to 74 is nearly equal to those of the belts 71 to 74 of the first embodiment. Lower ends of the belts 71 and 72 are secured to the toe guard portion 35, and lower ends of the belts 73 and 74 are secured to the sole 2. Upper portions of the belts 71 to 75 are sewn onto the opening reinforcement member 37. Between the adjacent belts, gaps 38 are formed. A shoelace 8 is inserted into a loop-shaped turning portion 70 formed at each upper end of the belts 71 to 75.

As shown in FIGS. 11 and 12, a cover sheet 4 may be provided to cover at least a forefoot portion of a shoe. Lower edges of the cover sheet 4 may be secured to a toe guard portion 35, an outsole 2 and a heel guard portion 36. Alternatively, lower edges of the cover sheet 4 may be detachably attached to a shoe through a fastener, button, hock, hook or the like.

The toe guard portion 35 preferably has a shape that covers a region extending from each distal end of a first to fifth toe of a foot to at least metatarsophalangeal joints $MJ_1$–$MJ_5$ (see FIG. 3). In the alternative, the toe guard portion 35 preferably has a shape that covers a region extending forwardly from the thenar and hypothenar of a foot. The heel guard portion 36 has a shape that covers at least a region extending from the rear end of a heel portion to a lower portion of a malleolus. The toe guard portion 35 and the heel guard portion 36 are formed of fabric, non-woven fabric, plastic sheet, natural leather, synthetic leather, or composite materials. The opening reinforcement member 37 is also formed of these materials.

According to the second embodiment, there is no upper provided, and a toe guard portion 35, a heel guard portion 36, an opening reinforcement member 37 and a plurality of spaced belts 71 to 75 cover a foot of a shoe wearer, which makes the weight of the whole shoe lighter. Moreover, a cover 4 disposed at least at a forefoot portion of a foot covers the gaps 38 formed between the adjacent belts 71 to 75, thereby decreasing the irregularities of the outer surface of a shoe, smoothing the outer surface, and reducing the air resistance.

Also, a cover sheet 4 prevents dirt or rain from entering a shoe through the forefoot portion of a shoe and also prevents the forefoot portion of a wearer from being wounded. Furthermore, since the cover sheet 4 covers the whole forefoot portion of a shoe, integrated aesthetic appearance of the forefoot portion of a shoe can be described by the cover sheet 4. Also, in this case, since tightening is conducted only by a shoelace, handling of the shoelace is improved.

Figure 13:
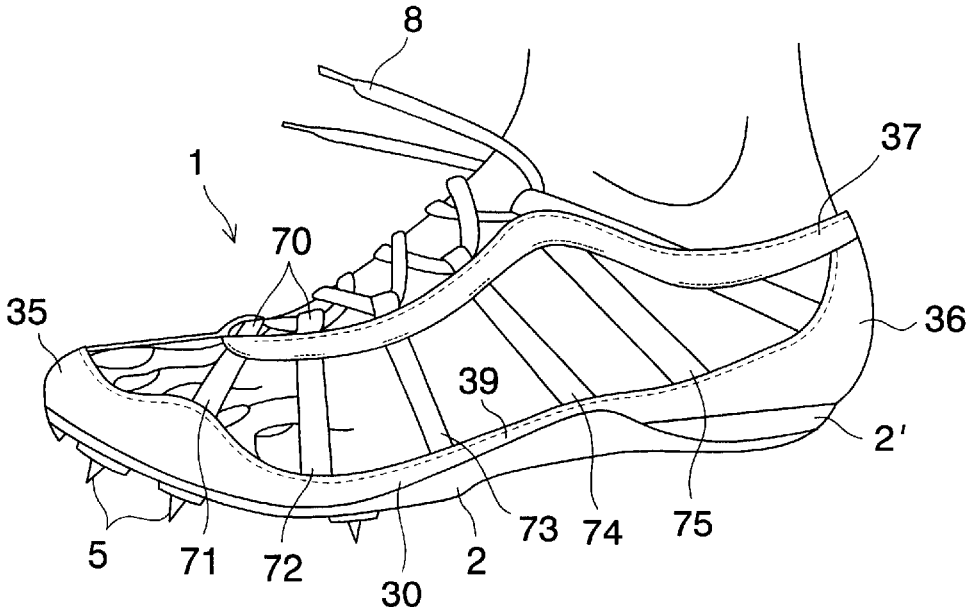
FIG. 13 is an alternative embodiment of FIG. 10.

In this second embodiment, as shown in FIG. 13, a band-shaped side reinforcement member 39 may be provided along the lower periphery of a shoe to connect a toe guard portion 35 with a heel guard portion 36. In this case, the side reinforcement member 39 is formed integrally with the toe guard portion 35 and the heel guard portion 36. The lower periphery of the cover sheet 4 may be secured to or detachably attached to the toe guard portion 35, the side reinforcement member 39, and the heel guard portion 36.

In each of the above three embodiments, the current invention is applied to an athletic shoe for a sprint or a short-distance dash, but it is also applied to an athletic shoe for a long-distance race such as marathon or jogging. In this case, an outsole is formed of a lighter material with higher wear resistance and greater slippage prevention function such as foamed rubber or foamed polyurethane. A midsole extends from the heel portion to the toe portion.

In addition, according to the events or races, a sole plate formed of synthetic resin with relatively higher modulus of elasticity and lighter weight may be placed at a region extending from the heel portion to the toe portion of a shoe, and a heel wedge with rich cushioning properties may be placed on the sole plate at the heel portion to form a laminate structure.

Those skilled in the art to which the invention pertains may make modifications and other embodiments employing the principles of this invention without departing from its spirit or essential characteristics particularly upon considering the forgoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. An athletic shoe comprising:

an outsole;

an upper having a toe portion, a heel portion, and an instep portion, said upper being secured to said outsole and having a plurlity of elongated through holes at regions except said toe portion and said heel portion;

a plurality of spaced, band-shaped members, wherein lower ends of said band-shaped members are secured to said outsole inside said upper, said band-shaped members extending upwadly spanning said elongated through holes toward said instep portion of said upper; and a fastening member connected to each upper end of said band-shaped members.

2. The athletic shoe of claim 1, wherein each of said band-shaped members is formed of synthetic resin fiber with a modulus of elasticity of at least 500 g/d.

3. The athletic shoe of claim 1, wherein lower ends of said band-shaped members are located at a first region extending from a position corresponding to a thenar eminence to a position corresponding to a calcaneus of a wearer on a medial side of said sole, a second region extending from a position corresponding to a hypothenar eminence to a position corresponding to a calcaneus of a wearer on a lateral side of said sole, a first position corresponding to a head of a proximal phalanx of a first toe of a wearer, and a second position corresponding to a bottom of a distal phalanx of a fourth toe of a wearer.

4. The athletic shoe of claim 1 further comprising a band-shaped tightening member, said tightening member extending from said heel portion of said upper to a medial side and a lateral side of said shoe, a part of said tightening member being engaged with said heel portion, each of medially and laterally extending portions of said tightening member being folded back toward said instep of a wearer at a turning portion provided at a lower region on said medial and lateral sides of said shoe, each distal end of said medially and laterally extending portions of said tightening member being tightened to said instep of a wearer.

5. The athletic shoe of claim 1 further comprising an openable cover sheet that covers at least said forefoot portion of said upper.

6. The athletic shoe of claim 5, wherein a lower periphery of said cover sheet is secured to or detachably attached to said sole or said lower periphery of said upper.

7. The athletic shoe of claim 5, wherein said cover sheet is formed of expandable stretch material.

8. The athletic shoe of claim 5, wherein a surface of said cover sheet is embossed.

9. The athletic shoe of claim 5, wherein a surface of said cover sheet is calendered.

10. The athletic shoe of claim 1 wherein said through holes extend substantially along a shoe length direction.

* * * * *

UNITED STATES PATENT AND TRADEMARK OFFICE

CERTIFICATE OF CORRECTION

PATENT NO. : 6,505,424 B1
DATED : January 14, 2003
INVENTOR(S) : Takeshi Oorei et al.

It is certified that error appears in the above-identified patent and that said Letters Patent is hereby corrected as shown below:

Title page,
Item [73], Assignee should read -- Mizuno Corporation, Osaka, (JP) -- not "Minumo Corporation, Osaka (JP) --.

Signed and Sealed this

Twentieth Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,505,424 B2
DATED : January 14, 2003
INVENTOR(S) : Takeshi Oorei et al.

It is certified that error appears in the above-identified patent and that said Letters Patent is hereby corrected as shown below:

Column 2,
Line 5, should read -- entry into a shoe. The band-shaped members are secured --
Line 15, should read -- because the band-shaped members extend upwardly toward --

Column 5,
Line 7, should read -- belt 74 is fixed to the rear end portion of the heel portion. --
Line 8, should read -- In addition, a metallic or plastic, D-shaped loop ring may --

Column 6,
Line 67, should read -- side of the upper 3, respectively --

Column 8,
Line 60, should read -- having a plurality of elongated through holes at regions --
Line 65, should read -- bers extending upwardly spanning said elongated --

Signed and Sealed this

Twenty-sixth Day of October, 2004

JON W. DUDAS
*Director of the United States Patent and Trademark Office*